United States Patent [19]

Nilsson

[11] Patent Number: 4,573,687

[45] Date of Patent: Mar. 4, 1986

[54] GOLF TRAINING DEVICE

[75] Inventor: Karl-Ivar Nilsson, Linkoping, Sweden

[73] Assignee: Klintland, Linkoping, Sweden

[21] Appl. No.: 504,831

[22] Filed: Jun. 16, 1983

[30] Foreign Application Priority Data

Jun. 29, 1982 [SE] Sweden ..... 8204011

[51] Int. Cl.[4] ..... A63B 69/36

[52] U.S. Cl. ..... 273/184 B; 273/200 R

[58] Field of Search ..... 273/200 R, 184 B, 185 C, 273/196, 198

[56] References Cited

U.S. PATENT DOCUMENTS 3,168,312 2/1965 Davis ..... 273/26

3,191,880 6/1965 Visconti ..... 273/200 R

FOREIGN PATENT DOCUMENTS 392412 5/1933 United Kingdom ..... 273/200 R

*Primary Examiner*—George J. Marlo

*Attorney, Agent, or Firm*—Hayes, Davis & Soloway

[57] ABSTRACT

This invention relates to a golf training device which includes a frame (1), a golf ball (2) which before a shot is placed on a specific place relative to the frame and which is also joined to one end of a cord (3). The other end of the cord (3) is joined to a cylindrical drum (12) which is mounted in bearings in the frame (1) to allow it to rotate and around which most of said cord (3) is wound. The golf training device also includes a device operatively connected to the drum (12) arranged to take up the kinetic energy which the golf ball (2) obtains at the shot, to indicate a corresponding distance and to lock the drum (12) at the same moment as the ball (2) stops after the shot.

4 Claims, 6 Drawing Figures

GOLF TRAINING DEVICE

Figure 1B:
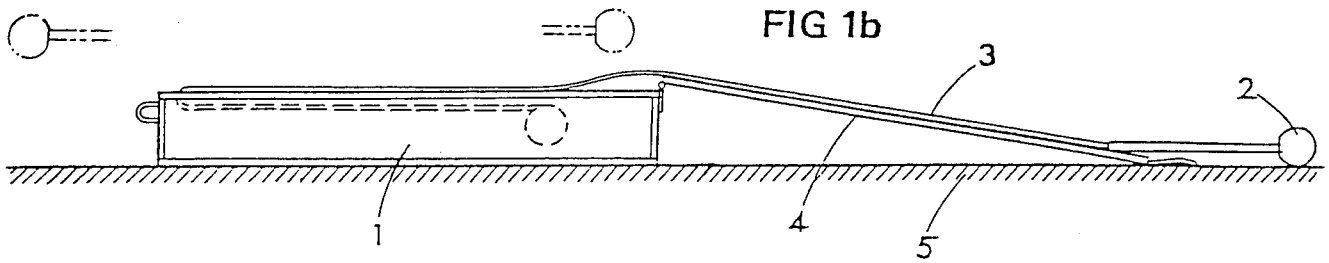

This invention relates to a golf-training device comprising a frame and a golf ball which is joined to the frame by a cord. The frame includes a rotatably mounted drum which is mounted in bearings to the frame. The cord is arranged to be wound around the cylindrical drum. Also included is a device operatively connected to the drum which device is arranged to take up the kinetic energy which the golf ball obtains when it is hit. The device also includes an indicator for indicating distance and a locking device for locking the drum at the moment the ball stops after being hit.

On such a golf training device of known type a friction brake connected to the drum is used to take up the kinetic energy which the golf ball obtains at the shot. At the shot the drum starts turning round its own axle and when it has been halted to a stand still it has turned a certain angle, which is used as a measurement on the distance of which a real golf ball would have landed if it had been shot under equal conditions. Therefore there are high demands on the retardation.

Obviously the braking action of a friction brake can vary within a wide range depending on for example dampness and dirt. On such a known golf training device the indication of distance is not completely reliable neither as concerns the absolute value of the measurement of distance nor the reproducability and therefore does not give a very good basis for the evaluation of the practice result.

Another disadvantage, which is serious enough, is that the friction brake of the known golf training device creates such a powerful retardation of the movement of the golf ball that its anchoring to the cord is jeopardized.

The object of the present invention is to achieve a golf training device of initially said kind, which does not suffer from above said disadvantages, but that gives an indication of distance which is accurate and reproducable and relates to a real distance. This is made possible according to the invention in that the device for taking up the kinetic energy the golf ball has obtained at the shot and for indicating a corresponding distance, consists of a wind-up spring which is a radially wound up leaf spring with an approximately constant wind up force arranged to be tightened when the cord is wound off the drum at the shot and that the drum is arranged to have a low moment of inertia and which has a track designed for the cord which like a thread with a specific pitch runs along said drum.

To reset the golf training device after a shot the cord must be rewound on the drum. This is achieved by means of the wind up spring, which is released as the distance indicator is set to zero. An even rewinding of the cord is achieved according to a special characteristic of the invention whereby a braking device is operatively connected to the drum, and which has no braking effect while the cord is wound off and has the biggest braking effect at the beginning of the winding up to successively decline to zero at the end of the winding up.

A cord is conventionally wound up on a drum by means of a mechanically movable arm, a so-called distributor, which distributes the cord evenly on the drum. A simpler and cheaper solution to this problem is achieved according to another characteristic of the invention whereby a bar-shaped device is arranged parallel to the axle of the drum so that the distance between the drum and said device is less than the diameter of the cord and that the cord is guided into the track between said device and the drum.

According to another characteristic of the invention, the braking device includes at least one brake-shoe of which the bearing pressure on a brake disc or a brake drum is decided by the tension of a spring, which is operatively connected to one end of a slewing bracket, while the other end of the slewing bracked is arranged to follow the pitch of thread like track, in such a way that the spring force is essentially zero when the cord is wound up on the drum, but increases in proportion to the winding off of the cord, and a simple and effective solution to the problem of getting an even wind up of the cord on the drum is achieved.

Figure 1A:
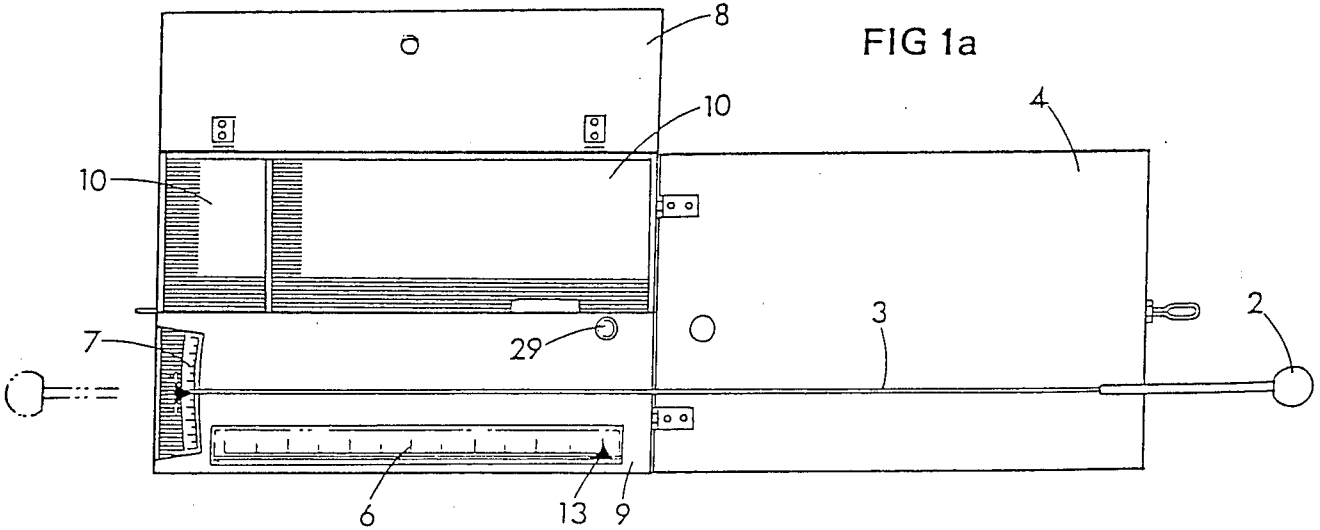

In the following the invention will be explained further with reference to the accompanying drawing where FIGS. 1*a* and 1*b* show plan views of a golf training device according to the invention, seen from above and from the side respectively.

Figure 2:
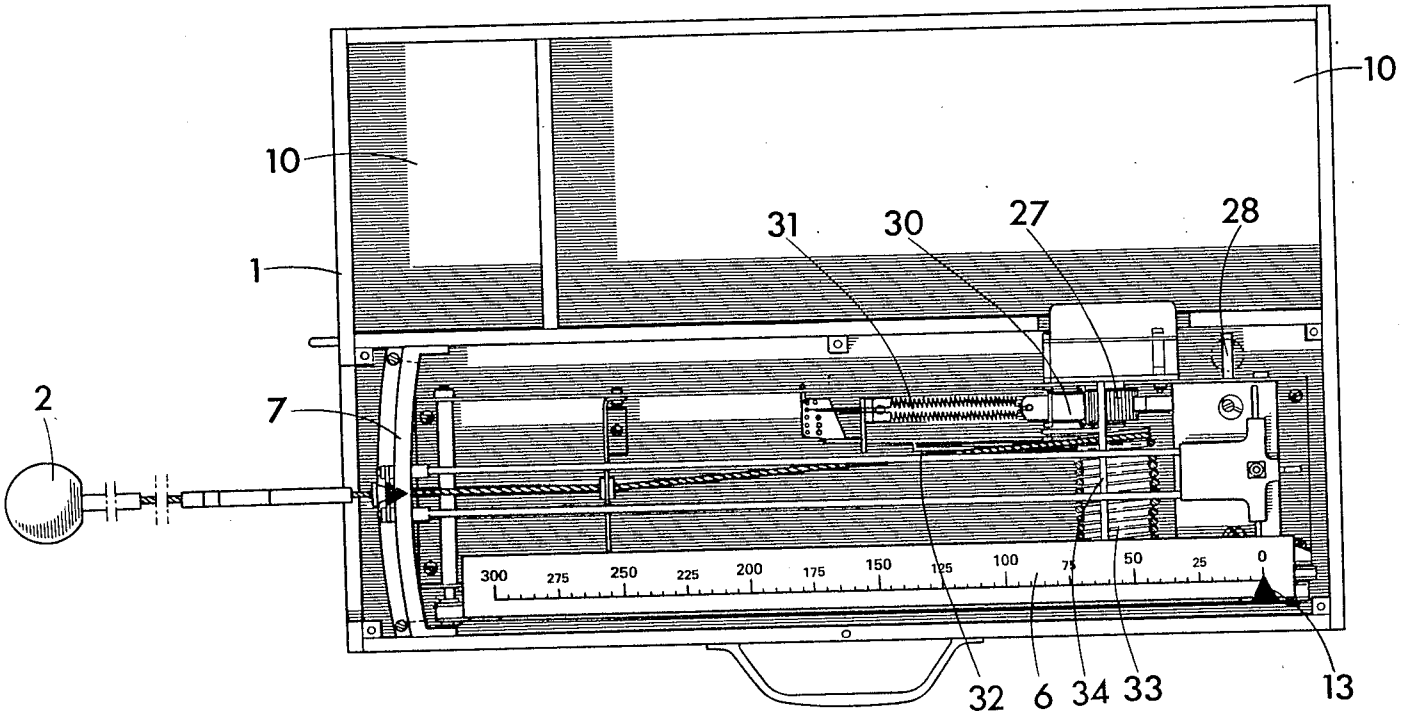
Figure 3A:
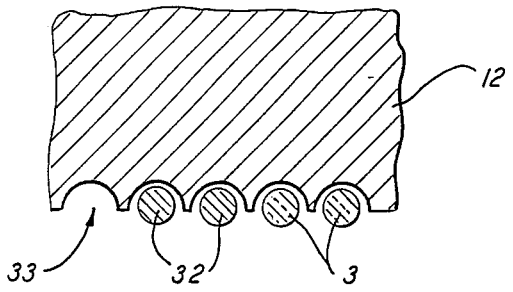
Figure 3:
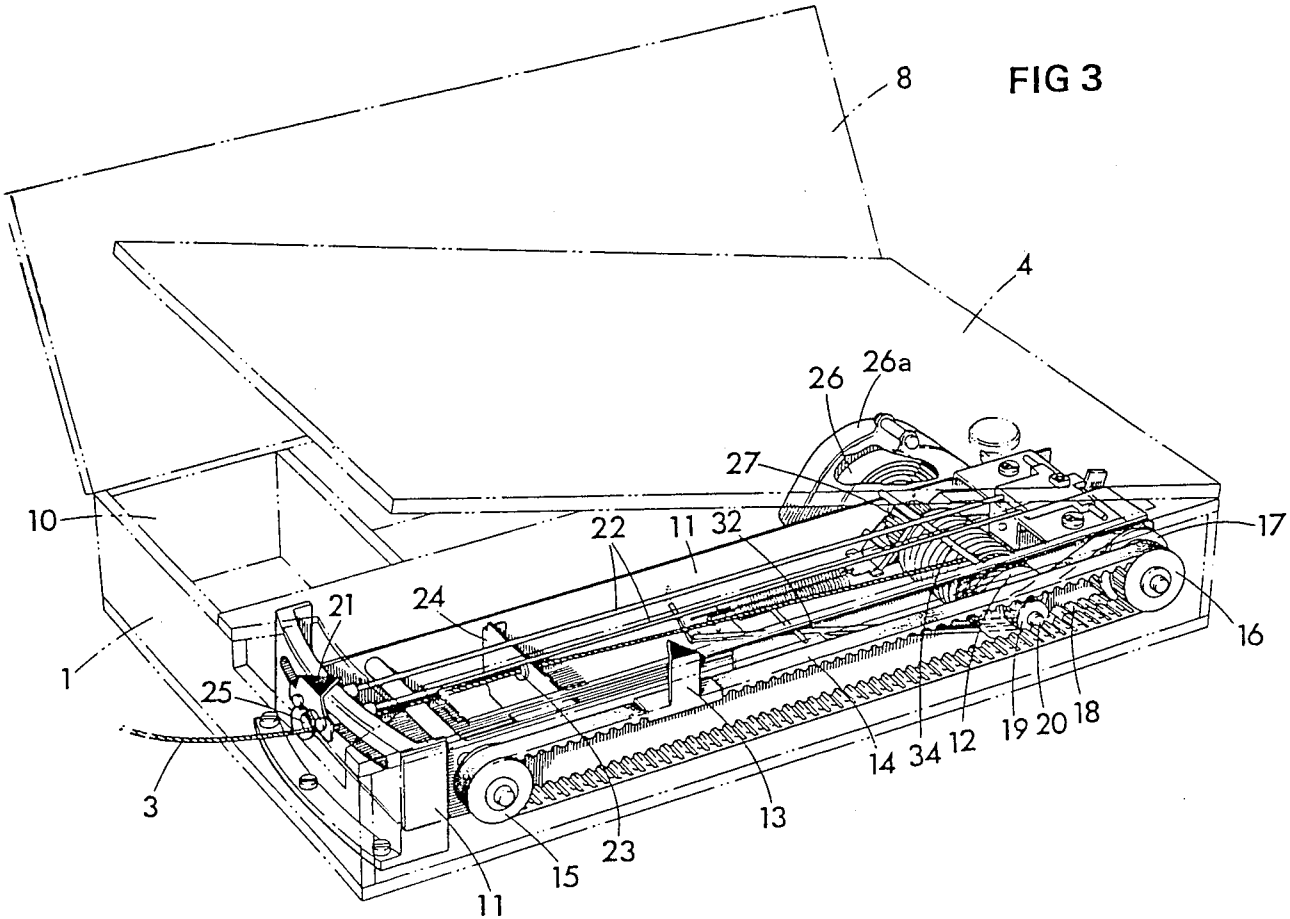

FIGS. 2 and 3 show the construction of the golf training device, in FIG. 2 viewed from above and in FIG. 3 in a perspective view obliquely from one side/obliquely from above.

A golf training device according to the present invention consists of a framework 1 in the shape of a parallellepipedical, flat box and a golf ball 2 which by means of a cord 3 is connected to a mechanism in the framework, which will be explained as follows. The box 1 has an upper lid 4, which is placed on the ground 5 and completely open when the golf training device is to be used, see FIG. 1*b*, so that the lid 4 forms a gradient. When the lid 4 is opened, the distance scale 6 and the side scale 7 can be seen. The box 1 also has two inner lids 8, 9, out of which lid 8 covers storage space 10 for storage of accessories and the golf ball 2 when the golf training device is not being used. Under lid 9 the mechanism of the golf training device is concealed.

The mechanism consists of a drum 12 mounted in bearings in a frame 11, in which most of the cord 3 connected to the golf ball 2 is wound up. The indicator of distance on the distance scale 6 is carried out by means of a pointer 13, which is fixed to a log belt 14 which runs over two rotating log wheels 15, 16 mounted in bearings. Log wheel 16 is joined to another log wheel 17 which by means of a log belt 18 is operatively connected to a log wheel 19 which is mounted in bearings on the axle 20 of the drum 12 and connected to this. Log wheel 19 has a smaller diameter than log wheel 17 in order to achieve a certain gear reduction, when the turning of the drum 12, via log wheel 19, belt 18, log wheel 17, 16 and belt 14 non-skiddingly, is transferred to a linear movement of the pointer 13. The indication of angle on the side scale 7 is achieved by means of an indicator 21, fixed to a swinging arm 22 mounted in bearings in the frame 11. From the drum 12, the cord 3 runs through a hole 23 in a fixed wall and through a hole 25 in the indicator 21. The fixed wall 24 with the hole 23 contributes to the deflection of the indicator 21 not being effected by how much of the cord 3 that is wound up on the drum 12.

To take up the kinetic energy the golf ball 2 obtains at the shot, a wind up spring 26, of the same type as a clockwork spring, operatively connected to the drum 12 and arranged in a shell 26*a*, is used according to this invention. The spring 26 is tightened successively as the cord 3 at the shot is wound off the drum 12, which hereby is made to rotate in a wind-off direction round its own axle.

An advantage with using a roll up spring 26 in this matter is that it has a suitable spring characteristic. The great importance of the spring characteristic for the function of the golf training device is perceived by the following: At the shot the golf ball obtains a very powerful acceleration. If this acceleration was taken up by a firm spring, this would mean great, and maybe too great a strain on the anchoring of the cord 3 in the golf ball 2 as well as the mechanism. The operative connection between the drum 12 and the wind up spring includes a readjustable locking device 27 arranged to lock the spring in the position it has at the same moment as the ball 2 stops after the shot, to lock the drum so that it will not rotate in a direction opposite to the winding off direction driven by the spring 26. Such an action would mean that the indicator of distance immediately would be set to zero, which would not be desirable.

Figure 2A:
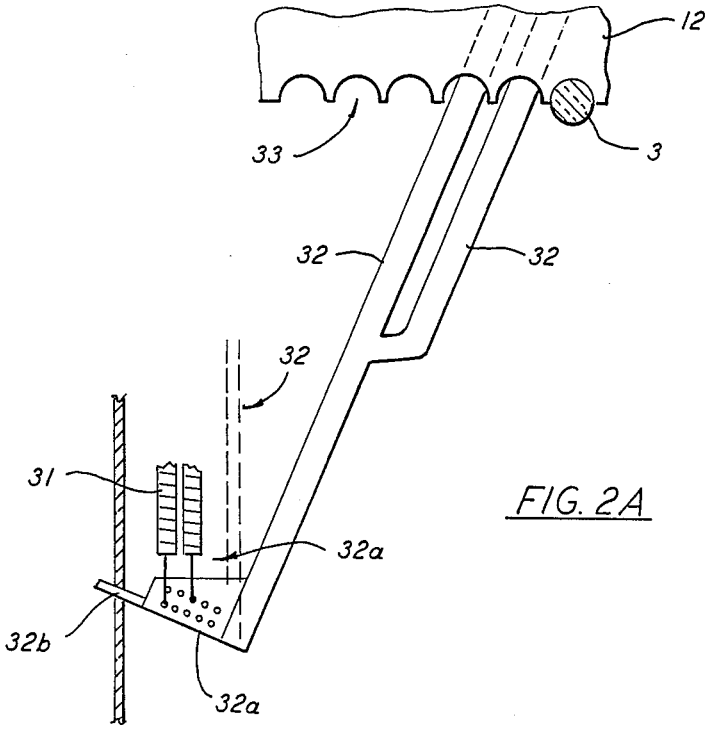

The golf training device according to this invention therefore includes a device for setting the indication of distance to zero perferably after the results shown on the side and distance scales 7 and 8 respectively has been observed. Said device consists of a linkage 28 which operatively connects a zero setting button 29 with the locking device 27 in such a fashion that the locking function of the locking device is released when the zero setting button 29 is pressed. To avoid the cord 3 being wound too quickly onto the drum 12, said drum is operatively connected to a braking device with a brake-shoe 30 of which the bearing pressure is greatest at the beginning of the winding up and successively decreasing to zero at the end of the winding up. The bearing pressure of the brake-shoe 30 is determined by the tension of a spring 31, which is operatively connected to one end of a slewing bracket 32 of which the other end is arranged to follow the pitch of a thread like track 33 arranged for the cord 3 on the drum 12. The operation of this slewing bracket 32 can be apparent from FIG. 2A and FIG. 3A, FIG. 2A being a section through the drum showing the ends of the bracket 32 engaging in the two adjacent empty grooves 33. In FIG. 3A the bracket 32 is in the position shown in FIG. 3 and has been moved to the right, thus rotating the base portion 32A around the pivot 32B which places the springs means 31 under tension. This places a greater frictional force on the brake 30. The position of the bracket 32 when the ball is at rest for the initial flight is partially shown in dotted line in FIG. 2A. This is the position illustrated in FIG. 2. This is carried out in such a fashion that the spring force is essentially zero when the cord 3 is wound up on the drum 12, but increases in proportion to the winding off of the cord 3. Thus, the brake force is greatest at the beginning of the winding up of the cord 3. The locking device is released at the winding off. To contribute to the cord 3 spreading evenly over the periphery of the drum 12, there is a bar 34 parallel to the axle 20 of the drum 12 on such a distance from the drum 12, that the distance between this and the bar 34 is less than the diameter of the cord 3. Thus the cord 3 is forced to follow the track 33 and connot overlap.

It is obvious that this invention may be modified in a number of ways within the scope of the invention. In the mechanism of the golf training device, for example, a printer can be included to automatically register the side and distance indications or be equipped with an appliance for such a printer.

I claim:

1. A golf training device comprising each of the following elements in combination: a frame (1), a golf ball (2) which before a shot is placed on a specific place relative to the frame (1) and which is also joined to one end of a cord (3), while the other end of said cord (3) is joined to a cylindrical drum (12) which is mounted in bearings in the frame (1) to allow it to rotate and around which most of said cord (3) is wound and a device operatively connected to the drum (12) arranged to take up the kinetic energy which the golf ball (2) obtains at the shot, to indicate a corresponding distance and to lock the drum (12) the same moment as the ball (2) stops after the shot, and characterized in that, said device consists of a wind up spring which is a radially wound up leaf type spring with an approximately constant wind up force arranged to be tightened when the cord (3) is wound off the drum (12) at the shot and that the drum (12), which is arranged to have a low moment of inertia, has a track (33) designed for the cord (3) which like a thread with a specific pitch runs along said drum, said track including a groove in the drum extending continuously around the drum and from one end of the drum to the other.

2. Golf training device according to claim 1, characterized in that, a bar-shaped device (34) is arranged parallel to the axle (20) of the drum so that the distance between the drum (12) and said device (34) is less than the diameter of the cord (3) and that the cord is guided into the track (33) between said device (34) and the drum (12).

3. Golf training device according to claim 1, where said device includes a device (28, 29) to set the distance indicator to zero, where as the drum (12) simultaneously is made to rotate under the influence of the tight spring to wind up the cord (3) on the drum (12), characterized in that, a braking device which is operatively connected to the drum (12), which has no braking effect while the cord (3) is wound off and has the biggest braking effect at the beginning of the winding up to successively decline to zero at the end of the winding up.

4. Golf training device device to claim 3, characterized in that, the braking device includes at least one brake-shoe (30) of which the bearing pressure on the brake disc or a break drum is decided by the tension of a spring (31), which is operatively connected to one end of a slewing bracket (32) while the other end is arranged to follow the pitch of the thread like track (33), in such a way that the spring force is essentially zero when the cord (3) is wound up in the drum (12), but increases in proportion to the winding off of the cord (3).

* * * * *